United States Patent [19]

Iversen

[11] Patent Number: 4,899,805

[45] Date of Patent: Feb. 13, 1990

[54] RAPID CHILL MOLD

[76] Inventor: Arthur H. Iversen, 151 Sobey Rd., Saratoga, Calif. 95070

[21] Appl. No.: 226,779

[22] Filed: Aug. 1, 1988

[51] Int. Cl.[4] ..... B22D 27/04

[52] U.S. Cl. ..... 164/348; 249/79

[58] Field of Search ..... 164/348, 122, 126, 128; 249/79

[56] References Cited

U.S. PATENT DOCUMENTS

| | | | |
|---|---|---|---|
| 2,428,660 | 10/1947 | Falk et al. | 164/348 X |
| 4,405,876 | 9/1983 | Iversen | 313/30 |
| 4,455,504 | 6/1984 | Iversen | 313/30 |
| 4,502,528 | 3/1985 | Frissora et al. | 164/348 X |
| 4,684,844 | 8/1987 | Iversen | 313/30 |

FOREIGN PATENT DOCUMENTS

| | | | |
|---|---|---|---|
| 61-162244 | 7/1986 | Japan | 164/348 |

*Primary Examiner*—Nicholas P. Godici
*Assistant Examiner*—J. Reed Batten, Jr.
*Attorney, Agent, or Firm*—Foley & Lardner

[57] ABSTRACT

A mold suitable for casting therein molten metal or other molten materials wherein the mold includes a heat exchange surface, the mold includes means for providing a flow of coolant liquid to remove heat from the heat exchange surface by formation of nucleate vapor bubbles on the heat exchange surface, the liquid tending to include a viscous sublayer adjacent to the heat exchange surface, the improvement wherein the heat exchange surface includes at least one of: means for forming pressure gradients in the liquid having a component perpendicular to the heat exchange surface to facilitate removal of the nucleate bubbles; and means for breaking up the viscous sublayer to facilitate removal of the nucleate bubbles, and wherein the heat exchange surface comprises a series of concave curved surfaces and wherein septum members with corresponding curved surfaces, which may be split to permit positioning into close proximity to the heat exchange surface to provide desired coolant flow characteristics over the surfaces of the mold heat exchange surface, the septum members being bonded to axial structure elements that fasten to end members mounted on the mold whereby support is provided to the septum members and desired liquid flow patterns are obtained.

26 Claims, 5 Drawing Sheets

F-F

RAPID CHILL MOLD

DESCRIPTION

1. Technical Field

The present invention relates to the casting of molten metal or slurries of molten metal into molds to form desired shapes and particularly concerns means for the efficient and rapid cooling of such molds.

2. Background of the Invention

In high throughput molding or casting operations such as are encountered in foundries fabricating magnesium automobile wheels, the substantial amount of heat stored in the molten metal requires a considerable time to be dissipated into the cooling jacket surrounding the mold. Thus, the throughput of the mold is dictated by the rate at which heat can be removed from the mold. A more rapid removal of heat increases part throughput thereby reducing manufacturing costs.

SUMMARY OF THE INVENTION

The present invention provides a liquid cooled mold that can dissipate power densities (heat flux) that are an order of magnitude greater than currently available.

The present invention also provides a rigid, self-supporting liquid cooled mold that permits an arbitrarily thin mold wall to be fabricated.

The present invention further provides a liquid cooled mold that may be operated at optimum liquid coolant flow rate and at low pressure.

DESCRIPTION OF THE DRAWINGS

FIG. 7A—A is a complete cross-sectional view of the threaded hose connection;

FIG. 7B—B is a complete cross-sectional view of the transition conduit showing the transition from the circular hose connection to the semi-circular body of the outer liquid flow jacket, showing as well fin or vane flow diverters;

FIG. 7C—C is a complete cross-sectional view of the juncture of the transition conduit with the semi-circular mold conduit, also showing sealing means such as elastomer gaskets;

FIG. 7D—D is a complete cross-sectional view of the semi-circular conduit, also showing sealing means such as elastomer gaskets;

FIG. 7E—E is a complete cross-sectional view of the termination of semi-circular mold conduit, also showing sealing means such as elastomer gaskets;

DETAILED DESCRIPTION OF PREFERRED EXEMPLARY EMBODIMENT

Figure 1:
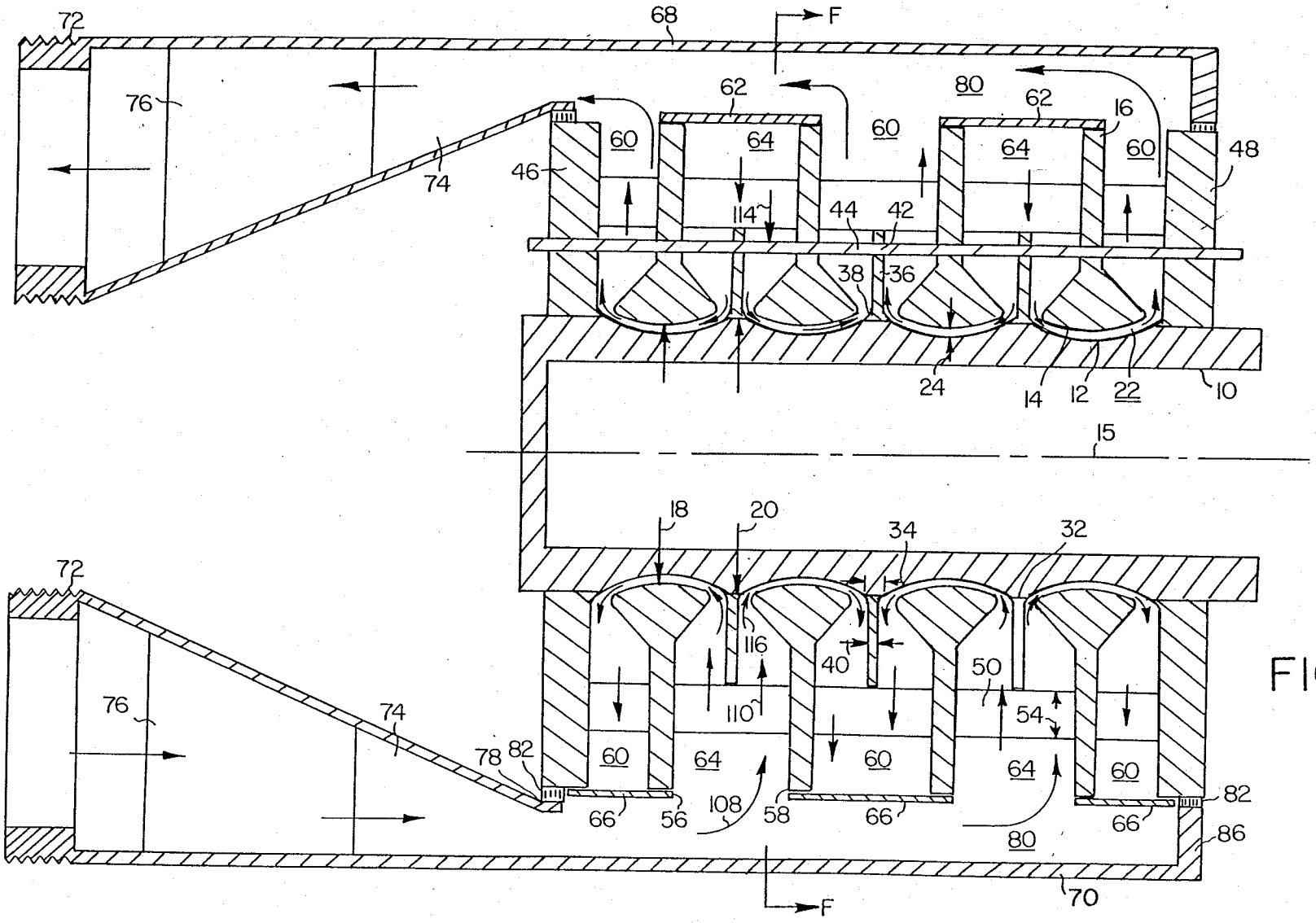
FIG. 1 is a complete cross-section view of a multi-curved surface of a liquid cooled mold containing all conduit elements for liquid flow according to the present invention.

The mold illustrated in FIG. 1 is shown as circular symmetric for ease of description. Mold shapes may be arbitrary as is to be seen in the castings of automobile wheels and hub caps. The principles of curved surface coolant design, as described herein, may be applied to molds or other casting means by suitably altering the geometry of the curved surface structures. While molds for use in foundries have been described herein, the present invention may be used for any other heat sink, cold plate or heat removal process where high cooling rates are desired.

Referring now to FIG. 1, shown is a mold 10 with a multiplicity of adjacent concave curved heat exchange surfaces 12, said heat exchange surfaces corresponding to heat exchange surfaces 186, 188 and 190 of FIG. 16 of U.S. Pat. No. 4,455,504. Again referring to FIG. 1 of the present invention, septum elements 16, which may also be called liquid coolant diverters, containing curved liquid flow diverter surfaces 14 are brought into close proximity to curved mold heat exchange surfaces 12 such that a curved liquid flow conduit 22 results. Curved surfaces, mold 12 and septum 14, are generally circular symmetric about mold axis 15. Height 24 of conduit 22 is generally constant, but may be varied by changing the curvature of either the mold surface 12 or septum surface 14, or both. In this manner, the heat transfer characteristics, as the combination of mold heat exchange surface curvature and liquid flow velocity may be varied and thereby optimized for different segments of the mold heat exchange surface. Curved flow diverter surfaces 14 of septum elements 16 correspond generally to curved surfaces 192, 194 and 196 of FIG. 16 of U.S. Pat. No. 4,455,504.

In general, conduit height 24 is small and the required inside diameter 18 of septum element 16 may be smaller than the outside diameter 20 of the mold. Thus, there is an interference fit when attempting to slide septum element 16 over mold 10.

Therefore, in order to position curved liquid diverter surfaces 14 into proper relationship with curved mold heat exchange surfaces 12, septum elements 16 must be cut into 2 or more pieces so that they may be brought into proper relative position as shown in FIG. 1.

Figure 2:
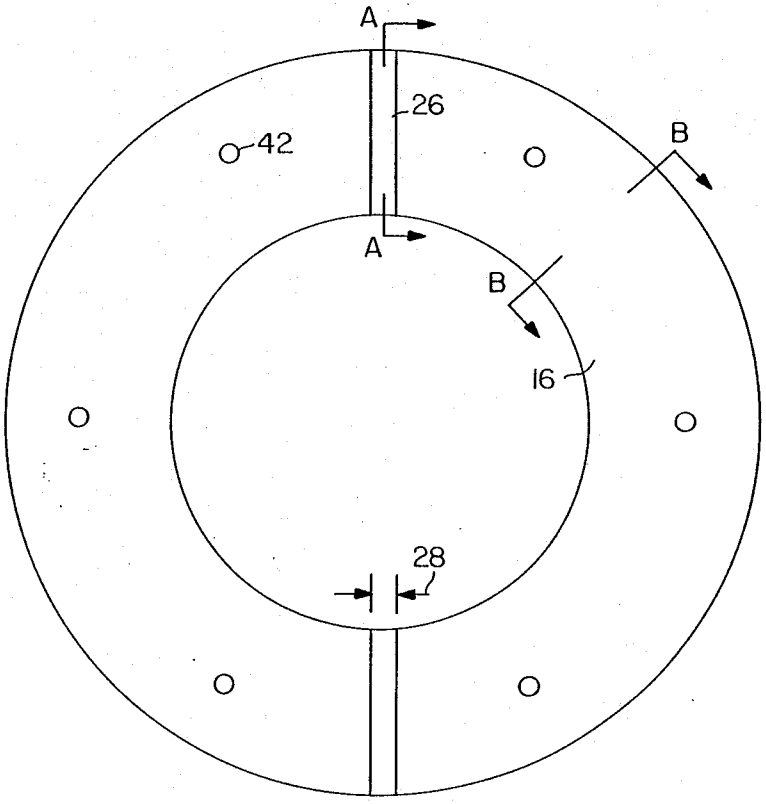
FIG. 2 is a complete frontal view of a flow diverter.

FIG. 2 provides a complete front view of septum element 16 illustrating a cut of width 28 to divide it into 2 parts so the two pieces may be brought in radially and positioned about the mold. Slot 28 has placed in it a replacement element 26 of thickness 28 equal to the slot width 28. The shape of replacement element 26, FIG. 2A—A, is identically the same as a cross-section, FIG.

Figure 3:
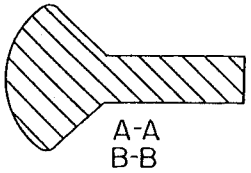
FIG. 3 is a partial cross-sectional view of a flow diverter showing the curved surface that is in close proximity to the curved mold heat exchange surface.

2B—B, of the septum 16 as shown in FIG. 3. The number of replacement elements 26 required equals the number of parts the septum 16 is cut into. Replacement elements 26 may be mounted on each of the septum sections 16 by adhesives, brazing, welding, screws etc. or may be inserted as a step in the assembly of the ducting system. When brought together, septum sections 16 once again form a circle upon insertion of replacement element 26.

Again referring to FIG. 1, the assembly of the liquid coolant ducting system proceeds as follows. Mold 10 is provided with a series of curved heat exchange surfaces 12, shown here as flutes with flattened cusps 32, the width 34 of the flat region being small compared to the arc length of the fluted heat exchange surface 12. Washers 36, having an inside diameter slightly larger than the outside diameter 20 of the mold and a thickness at the inside diameter corresponding to the width 34 of the flat region of mold 10, extending radially outward from the cusps 32.

Curved surfaces 38 are provided on both sides of washer 36, the thickness stabilizing at a value 40 which is less than its thickness 34 at the inside diameter.

Washer 36, which is joined to mold 10 at each of the flattened cusps 32, serves three important functions. First, it serves as a spacer between adjacent septum elements 16 and thereby prevents any liquid flow oscillations that might occur which could send more liquid over one flute element (mold heat exchange surface 12) than its neighbor which is fed by the same flow. This reduction in flow could cause premature burn-out in the fluid starved flute element (heat exchange surface). Secondly, washers 36, which are placed over and bonded circumferentially to each flattened cusp 32 of mold 10, serve mechanically to circumferentially stiffen the mold against collapse in the radial direction. This permits the mold wall to be very thin thereby reducing thermal stress through the mold wall and permitting high heat flux dissipation to be achieved. Thirdly, washers 36 are precision drilled with holes 42 at periodic circumferential intervals through which axial support rods 44 are inserted. Axial support rods 44 serve as mounting elements for septum 16. Septum 16 is also precision drilled with holes 42. FIG. 2 also shows holes of diameter 42 in septum 16. As can be seen, septum 16 has 3 holes in each of the two segments to accept a total of 6 support rods.

Again returning to FIG. 1, axial support rods 44 serve two important functions. First they serve as mounting means for septum elements 16 whereby the axial and radial positioning of curved flow diverter surface 14 is maintained in precise relationship to curved mold heat exchange surfaces 12. Second, axial support rods 44 serve as mechanical stiffening means for the mold 10 in the axial direction in conjunction with multiple washers 36 and end plates 46 and 48, which are bonded by adhesives, brazing, tack welding, etc. to axial rods 44, a rigid self supporting structure is formed that is structurally independent of the mold 10. Thus, the mold wall thickness may be made as thin as desired to optimize heat transfer with substantially reduced concern for mold collapse when operated at high heat fluxes. Axial support rods 44 pass through holes 42 in end plate 48, through holes 42 in multiple washers 36, and then through holes 42 in opposite end plate 46. Precise tolerances are maintained regarding the diameter and positioning of holes 42 in end plates 46 and 48 and washers 36. It is these tolerances that insure that conduit 22 is within precise tolerances. Precise axial alignment of septum 16 is obtained with spacers during the bonding of septum 16 to axial support rods 44. Other shapes for support rod 44 may be used such as thin metal strips positioned radially to minimize coolant turbulance.

In general end plates 46, 48 and multiple washers 36 are brazed to mold 10. This assures maximum strength and mechanical rigidity, and good thermal conductivity. Since these parts are external to the vacuum envelope, material selection is not critical. To match coefficients of expansion as well as retain high thermal conductivity and good corrosion resistance, dispersion strengthened copper may be used, such as those alloys with small amounts of zirconium or chromium or alumina or berylium or silver. These coppers have high strength at elevated temperatures. In general, parts 46, 48 and 36 are immersed in liquid coolant and so do not operate at elevated temperatures. If matching coefficients of expansion is desirable, axial support rods 44 should also be made of the same copper material. For galvanic corrosion inhibition reasons, septum 16 may also be made from the same copper material. Other suitable corrosion resistant materials include monels, steels, brass, stainless steels, superalloys, ceramics, etc. Bonding of septum 16 to axial support rods 44 may be by adhesives, brazing, tack welding, etc. Thus, the mold coolant ducting subassembly, (FIG. 1) contains end plates 46, 48, washers 36, and septum elements 16 all joined together by axial support rods 44.

Figure 4:
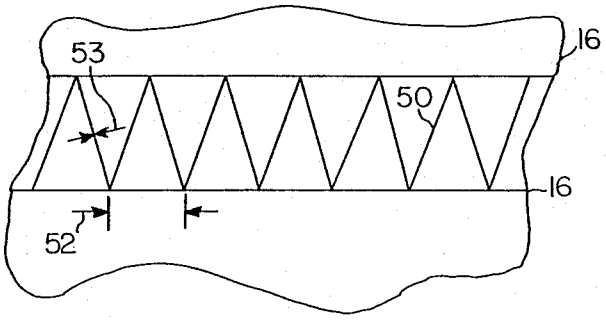
FIG. 4 is a partial side view of a radial liquid flow diverter, hereinafter sometimes called a RF diverter, spaced between adjacent flow diverters.

Radial liquid flow diverter 50 is positioned between adjacent septum elements 16 to insure a radial flow of coolant by substantially removing any circumferential component of velocity. FIG. 4 shows a partial side view of radial flow diverter 50 positioned between adjacent septum elements 16. Radial flow diverters, generally having the appearance of fins, are made of thin metal and for ease of manufacture may be folded into an accordian "V" pleat for ease of insertion. Other shapes, such as a "U" shape, may be advantageous. The circumferential pitch 52 should be small compared to the radial length 54 (FIG. 1) to insure substantial removal of any circumferential component of velocity in the liquid as it flows radially toward heat exchange conduit 22. Radial flow diverter 50 may be supported by the peripheral surface of washer 36 or axial support rod 44. Radial flow diverter 50 may be bonded to septum elements 16 and end plates 46 and 48 by adhesives, brazing, i.e. low temperature silver, zinc, or tack welding. In general, axial support rods 44 are positioned sufficiently radially distant from heat exchange conduit 22 such that any liquid flow irregularities have been substantially smoothed out upon entering conduit 22.

Figure 6:
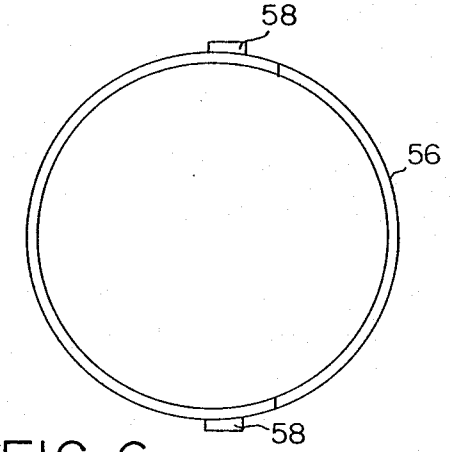
FIG. 6 is a complete end view of the IO diverter.
Figure 5:
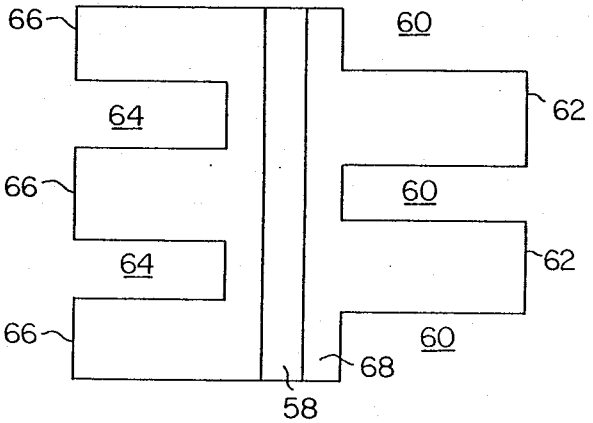
FIG. 5 is a complete top view of the input-output (IO) liquid flow diverter, hereinafter sometimes called IO diverter, used to isolate the incoming liquid from the outgoing liquid in the region where the direction of liquid flow changes from axial to radial for incoming coolant, and, radial to axial for outgoing coolant.

Cylindrical input-output liquid flow diverter 56 (IO diverter) containing circumferential slots of less than 180° is slipped over end plates 46, 48 and septum elements 16. The inside diameter of cylindrical IO diverter is a close fit to the outside diameters of end plates 46, 48 and septum element 16, so that where they overlap 58 they may be joined by adhesives, brazing etc. Joints at 58 need not be hermetic but should be sufficient to keep leakage between adjacent chambers within acceptable limits. FIG. 5 is a complete side view of the IO diverter 56 corresponding to the cross-section shown in FIG. 1. FIG. 6 is an end view of the cylindrical IO diverter. It should be noted the cylindrical construction of the IO diverter is shown for ease of illustration. Curved strips of sheet metal, each greater than 180° to provide the needed overlap for the axial elastomer seal, may be laid down such that the same result is obtained. The upper slots of FIG. 5 and FIG. 1 define a conduit 60 through which the heated coolant transitions from radial to axial flow to be discharged. Approximately semi-cylindrical bands 62 seal off intermediate conduits 64 defined by adjacent septum elements 16. Axial solid strip 68 with elastomer sealing means 58 serves to isolate input coolant conduit jacket from the output coolant conduit jacket (FIG. 5). Again referring to FIG. 5 and FIG. 1, the lower slots define conduits 64 through which input coolant transitions from axial to radial flow towards the mold heat exchange conduit 22. Again, approximately semi-cylindrical bands 66 seal off the coolant discharge conduits 60 defined by adjacent septum elements 16.

Figure 10:
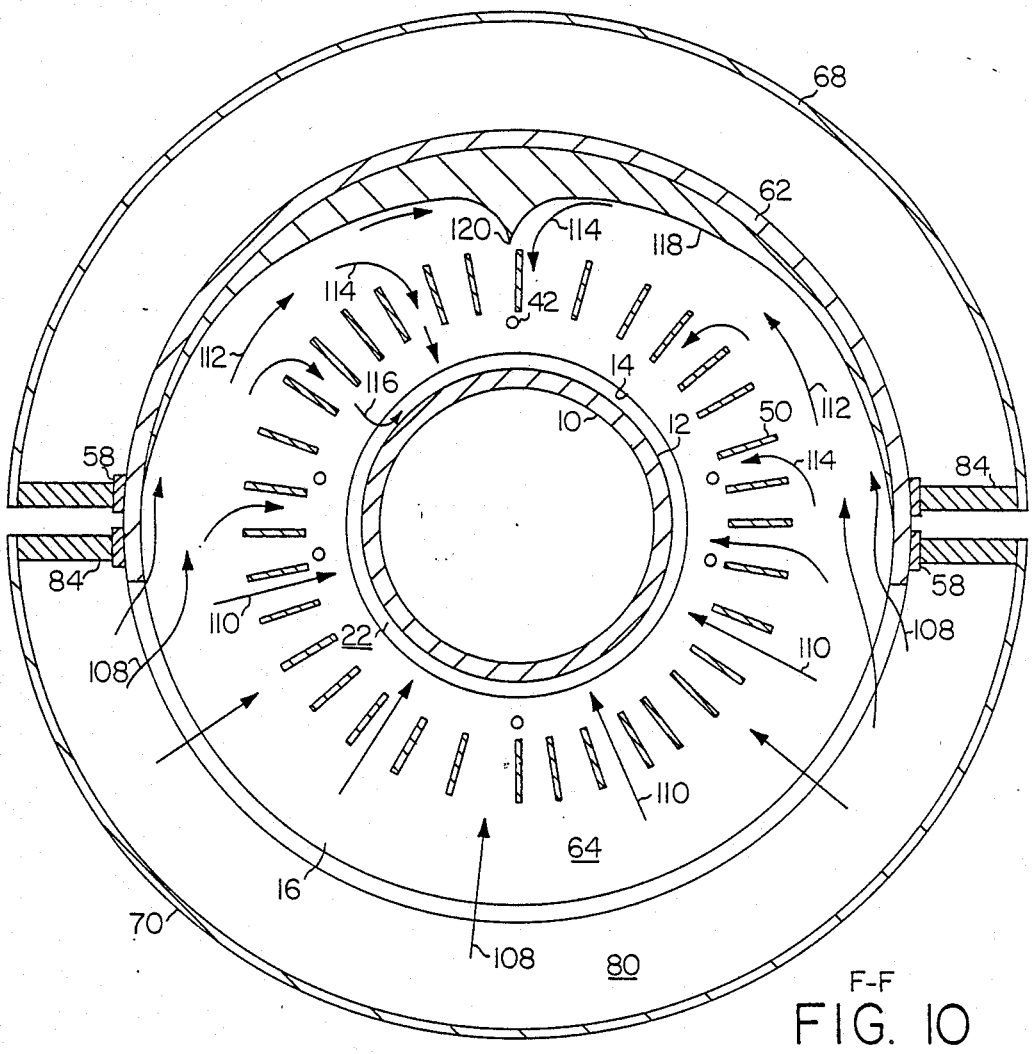

FIG. 10 provides the full cross-sectional view F—F of FIG. 1 illustrating incoming liquid coolant flow as it transitions from axial flow to the desired 360° radial flow prior to passing through the mold heat exchange region. Referring now to FIG. 10, incoming coolant flow, arrows 108, are shown entering radial input conduit 64 from axial flow input conduit 80 of axial flow input jack 70. For the almost semicircular input region of 64 corresponding to conduit 80, coolant flow is substantially radial inward, as shown by arrows 110. The other approximately semicircular input region 64 corresponding to IO diverter band 62, the coolant flows circumferentially, arrows 112, and then transitions to radial flow, arrows 114, while passing through radial flow diverters 50. The coolant, arrow 116, then passes through the mold heat exchange region 22.

From each extreme of axial flow input conduit 80, approximately 180° apart, the coolant flow travels approximately 90° to meet at the middle of IO diverter band 62. This 90° essentially represents the minimum practical circumferential distance coolant must travel prior to inward radial flow. As previously discussed, by maintaining input region 64 large compared to heat exchange region 22, the relative pressure drop in region 64 is relatively small, and thus liquid flow rates are substantially 360° uniform in region 22. Alternately, or in combination, liquid flow diverter 118 may be used to vary the coolant flow characteristics as they travel circumferentially under IO diverter band 62. As liquid feeds into the heat exchange region 22 as shown by arrow 116, the circumferential coolant velocity decreases and reaches its minimum at the mid-point of IO diverter band 62 where the last of the liquid has been directed radially inward. Liquid flow diverter 118 is seen to progressively decrease the cross-section of input region 64 under IO diverter band 62, reaching a minimum at mid-point 120. By decreasing or varying the cross-section of region 64 under IO band 62 with diverter 118, the liquid velocity may be kept constant, increased or decreased in this region. This compensates for the liquid being progressively fed through that approximately 180° (90° from each side) of heat exchange region 22 that is under IO band 62. Thus, optimum flow characteristics may be obtained.

The cross-section shown, F—F, for the coolant flow input region, is substantially the same as would be obtained were a cross-section taken of the output region, that is, showing flow in region 60 and in axial flow output jacket 68. The major difference is that the direction of arrows showing coolant flow would be reversed, that is, showing outgoing coolant instead of incoming coolant. It should be noted that once the coolant has passed the mold heat exchange surface, control of the liquid flow characteristics is no longer critical and techniques such as flow diverter 118 may not be required.

Figure 7:
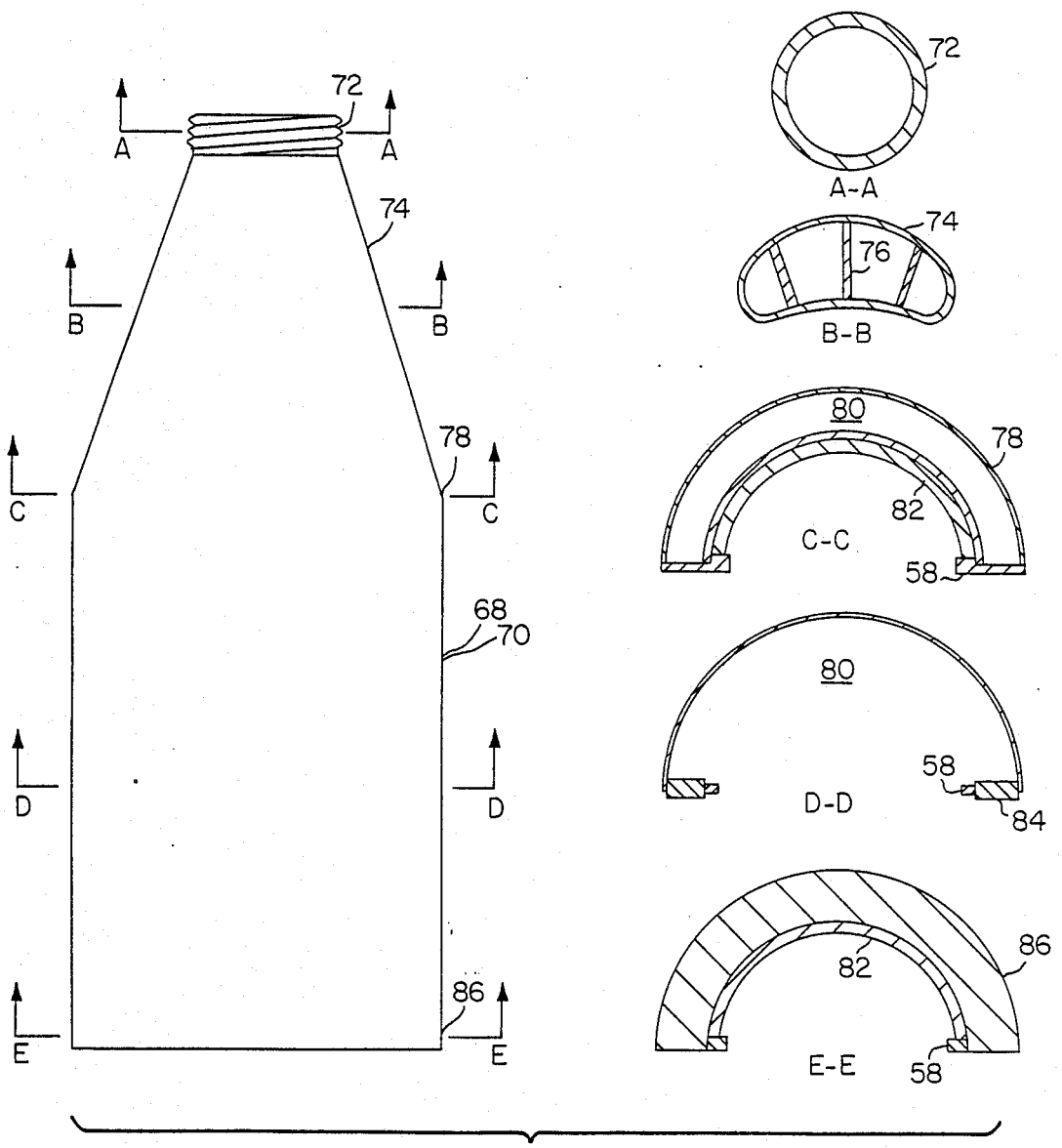
FIG. 7 is a complete top view of either the axial flow input or output jacket.

FIG. 7 is a complete top view of either the axial flow input 70 or output 68 jacket. The input 68 and output 70 jackets are shown separately in FIG. 1. Referring to FIGS. 1 and 7, input coolant enters liquid input jacket 70 at hose connection 72. Coolant then traverses transition region 74 which may contain flow diverting vanes 76 to obtain desired flow patterns. Coolant then transitions into semi-circular input conduit 80 through mold sealing junction 78, said junction containing semi-circular sealing means 82, such as an elastomer. Semi-circular axial flow input conduit 80 feeds radial flow input conduits 64. The output conduit 60 in the axial flow input region 80 are sealed by IO diverter bands 66. After entering radial input conduit 64, the coolant flows through the fins of radial liquid flow diverter 50 where any circumferential component liquid velocity is substantially removed. After passing through heat exchange conduit 22, the heated coolant proceeds radially outward in discharge conduit 60 where it transitions into output jacket 68 through axial flow output conduit 80. From there it passes through transition region 74 and out hose connection 72 to a heat exchanger.

Figure 8:
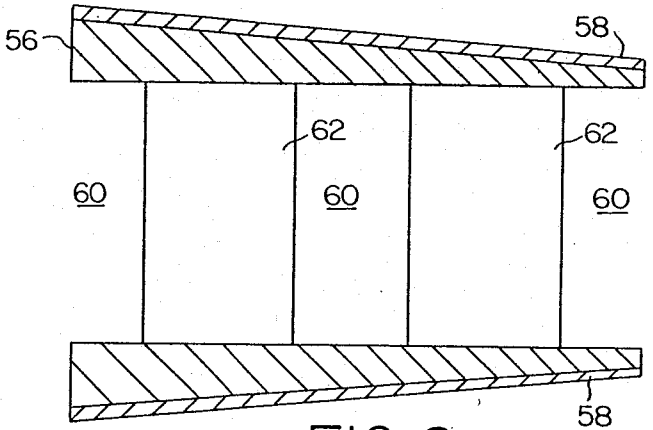
FIG. 8 is a complete cross-sectional view of the IO diverter showing a conical outer surface and attached axial sealing means such as elastomer strips, said view being at right angles to FIG. 5 and through the elastomer strips.

The axial flow input 70 and output 68 jackets are shown as two separate but identical parts in FIGS. 1 and 7. They may be connected by a hinge to make a clamshell structure that can clamp around the mold duct assembly as shown in FIG. 1. The axial seal 58 separating the input and output jackets is seen in FIG. 5 and 7. Axial member 84, FIG. 7D—D, provides the axial sealing surface for the input and output jackets. An alternative approach to mounting the axial flow input and output jacket on the mold conduit assembly is to construct the input-output liquid flow diverter 56 in such manner that the outer surface is conical, FIG. 8. Elastomer sealing means 58 would be mounted as previously described. The axial flow input and output jacket could now be one circular piece, with the axial input and output flow region 80 being constructed of a cylindrical member with axial members 84 (FIG. 7) tapered to mate with the conical surface 56 (FIG. 8), thus maintaining proper sealing relationship with axial elastomer strip 58. The terminating end 86, FIG. 7E—E, of the axial flow jacket 68, will require a larger inside diameter than the transition end 78 to accommodate the tapered IO diverter 56. Thus, the cylindrical input-output jacket is slipped onto the mold sub-assembly where mating seals are made.

The general nature of the present invention is such that relatively low pressure drops can be expected across the heat exchange conduit 22. To maintain essentially uniform circumferential heat transfer across the heat exchange surface, uniform circumferential pressure is desired inasmuch as limiting heat transfer, i.e. burnout, is determined by that section of the heat exchange surface with the lowest coolant velocity. To establish uniform radial flow rates around the circumference of the mold and into the heat exchange conduit 22 (FIG. 1), liquid flow diverting means such as fins or curved vanes, such as shown in FIG. 7B—B and illustrated as vanes 76, may be incorporated into the axial flow conduit 80 (FIG. 1) for both the input and jackets 68 and 70. Radial flow diverters 50 FIGS. 1 and 4 may be incorporated in the radial input 64 and output 60 conduits. A further means to minimize circumferential pressure variations in the heat exchange conduit 22 is to maintain input and output axial flow conduit 80 and radial input 64 and output 60 conduits at low pressure drops. Since pressure drops are proportional to the velocity squared of the coolant flow, the cross-section of the heat exchange conduit 22 is made small compared to the cross-sections of the axial flow conduit 80 and the radial flow conduits 60, 64. A large cross-section ratio means a low relative velocity. To this end axial flow input and output conduits 80 are each made semi-circular, together constituting the circumference of the coolant conduit.

Thus, only a modest height of conduit 80 is needed to provide a large cross-section. Moreover, the semi-circular geometry of the conduit simplifies control of the liquid flow when transitioning from axial flow to uniform 360° radial flow.

The viscous or laminar sublayer—a thin layer of laminar flow adjacent to the wall of the conduit and always present in turbulent flow—provides a mechanism to cause the nucleate bubbles to adhere more readily to the mold surface. The rate of nucleate bubble removal may be increased by breaking up this viscous or laminar sublayer. As described in U.S. Pat. No. 4,405,876 issued 9/20/83 to A. Iversen, such viscous sublayer can be broken up by roughening the mold coolant surface. When the height of the roughening projections ranges from 0.3 times the thickness of the viscous sublayer to about twice the thickness of the viscous sublayer and transition zone, the sublayer is substantially broken up. Breaking up the viscous sublayer enables the turbulent fluid to reach the base of the nucleate bubble, where it is attached to the mold, thereby providing additional energy needed to break it loose.

Cavities placed on the heat exchange surface may be used to promote efficient nucleate boiling thereby enhancing the heat transfer process. The dimensions of the cavities and their spacing on the mold heat exchange surface is such that for given coolant operating parameters, boiling nucleate bubbles of optimum sizes and distribution are formed such that under the condition of maximum heat flux, film boiling does not take place while obtaining maximum heat flux transfer and the highest critical heat flux. A regular roughness geometry can be obtained by suitable conventional techniques such as, for example, chemically by means of chemical milling; electronically, by the use of lasers or electron beams; or mechanically, by broaching, hobbing, machining, milling, stamping, engraving, etc.

Another method of obtaining a surface with crevices for forming nucleate bubbles is the use of a thin porous metal layer adherent to the mold at the mold heat exchange surface. This porous metal layer may be considered to provide a contoured surface as defined above. Relatively uniform pore size can be obtained by fabricating the porous structure from metal powders with a narrow range of particle sizes. Methods, such as described in U.S. Pat. No. 3,433,632 issued to Ebbertotal on Mar. 18, 1969, are well suited to provide the desired metal structure.

Figure 9:
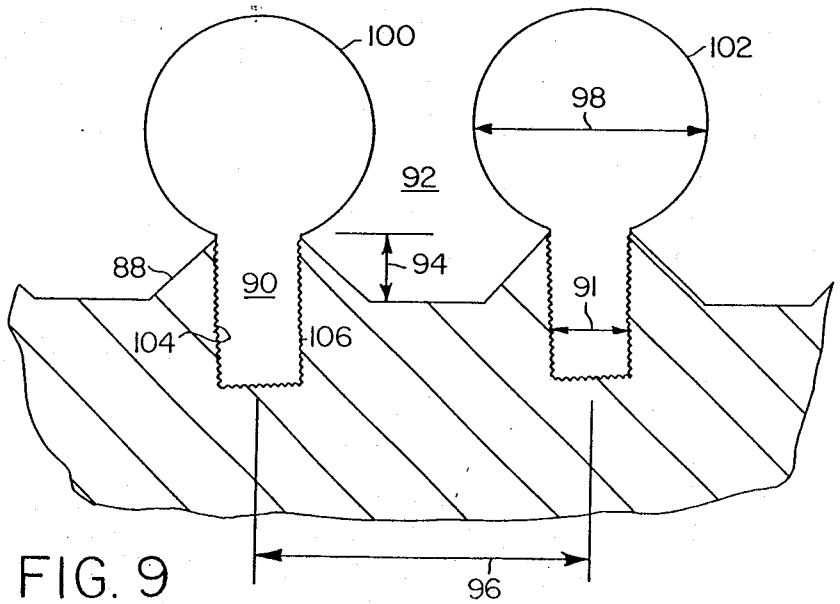
FIG. 9 is a partial cross-section view of surface roughness elements disposed on the mold heat exchange surface in the form of approximate truncated cones containing cavities exposed to the liquid coolant; and, FIG. 10 is a full cross-section view F—F of FIG. 1 illustrating the transition from axial flow to radial flow prior to passing through the mold heat exchange region.

Referring to FIG. 9, the surface roughness is in the approximate form of a truncated cone 88 which contain a cavity 90 which is exposed to the liquid coolant 92. The dimensions of cavities 91 of truncated cone 88 generally range from about 0.002 mm to 0.2 mm. The height of the roughness elements 94 ranges from 0.3 the height of the viscous sublayer to no more than twice the combined height of the viscous sublayer and the transition zone. For example, water at a velocity of 50 ft/sec. has a viscous sublayer thickness of about $5\times10^{-3}$ mm and a transition zone thickness of about $25\times10^{-3}$ mm. Spacing 96 between adjacent cavities is determined by maximum nucleate bubble diameter 98 such that at maximum heat flux, adjacent bubbles 100 and 102 do not merge to form the destructive film boiling condition. Spacing 96 between cavities generally ranges between 0.03 mm and 3 mm. Bubble size is determined by liquid and environment characteristics such as viscosity, surface tension, density, pressure etc. Suitable methods for fabricating the cavities 90 include the use of laser drilling and mechanical drilling. The inside surface 104 of cavities 90 is further prepared with micro cavities 106, preferably re-entrant, with dimensions generally in the range of $10^{-4}$ to $10^{-2}$ mm. Micro cavities 106 serve as vapor traps that remain in equilibrium with the liquid under all conditions, including those of lowest temperature and highest pressure, and serve as the initial nucleate boiling sites until the larger cavities 90 commence nucleate boiling. Thus, full scale nucleate boiling becomes a two-step affair, with initial nucleate boiling taking place at the trapped vapor sites 106, and then when sufficient vapor has been accumulated in the larger cavities 90, they take over. Micro cavities 106 act much like the starting motor in an automobile. Micro cavities 106 may be created by judicious selection of diamond, or other cutting material, particle size which is embedded in the drill bit. With the laser, reactive vapors or gases may be introduced which react with the mold material to create the desired pitting effect. Also, the outer surface of the truncated cone may also possess micro cavities due to the laser melting of material and subsequent deposition action at the edge of the cavity 90.

It will be understood that the above description is of preferred exemplary embodiments of the present invention and that the invention is not limited to the specific forms shown. Modifications may be made in the design and arrangement of the elements without departing from the spirit of the invention as expressed in the appended claims.

I claim:

1. A liquid cooled mold, comprising:

a. a mold assembly having a heat exchange region including a heat exchange surface for external cooling of said mold by a moving liquid coolant characterized in part by an associated velocity vector, said heat exchange surface comprised of at least one concave periodic curve;

b. coolant diverter means disposed in said heat exchange region outwardly proximate said heat exchange surface for controlling fluid flow to create a pressure gradient having a component generally perpendicular to said heat exchange surface upon flow interaction of said moving liquid with the concave curved heat exchange surface, wherein said diverter means envelops each of said periodic curves to maintain essentially uniform flow characteristics across said heat exchange surface at all points; and c. ducting means for alternate injection and removal of coolant along a flow path across said heat exchange surface.

2. The mold of claim 1, wherein the instantaneous inside diameter of said coolant diverter is less than the projected outside diameter of said mold, said coolant diverter being segmented into a plurality of arc segment members and joining members of identical cross-sectional configuration for securing said segments together and forming said diverter about said mold.

3. The mold of claim 1, further comprising support means disposed about and bonded to said coolant diverter, spaces from said mold heat exchange surface such that there is no substantial affect on the liquid flow characteristics over said mold heat exchange surface by said support means.

4. The mold of claim 3, wherein said axial support means comprises end plates disposed at each end of the mold and bonded thereto and encompassing therebetween said mold heat exchange surfaces and associated liquid coolant diverters, said end plates and said liquid coolant diverters having a plurality of holes in registry receiving shaft means for supporting said liquid coolant diverters in precise relationship with said mold heat exchange surfaces.

5. The mold of claim 1, further comprising spacing means bonded to said mold at the junction of each of the adjacent curved mold heat exchange surfaces, whereby rigidity is provided to the mold.

6. The mold of claim 4, wherein thin generally radially extending washers of suitable material are bonded to the mold at the junctions of the curved mold heat exchange surfaces, the washers also having holes to accept said shafts and being bonded thereto for further improving rigidity in the mold.

7. The mold of claim 6, further comprising radial flow diverter means disposed between adjacent liquid coolant diverters to substantially remove any circumferential component of coolant velocity.

8. The mold of claim 7, wherein said radial flow diverter means comprises a thin sheet of structurally stable, environmentally passive material folded in accordian of "U" fashion, the distance between adjacent folds being smaller than the height, wherein the coolant flows radially through a channel whose width is smaller than the length thereof thereby smoothing out any circumferential component of liquid velocity.

9. The mold of claim 6, further comprising flow guidance means to alternately provide coolant input and output flow to conduits defined by adjacent liquid coolant diverters.

10. The mold of claim 8, further comprising flow directing means for directing coolant alternately inwardly and outwardly through adjacent conduits defined by said coolant diverters, said flow direction means comprised of a member disposed over said diverters having alternate sections removed, each less than 180° and opposite one another to define continuous axial strips, each of the removed sections positioned over said conduits with the inside surface of said cylinder being bonded to said conduit diverter to seal adjacent conduits one from another.

11. The mold of claim 9, further comprising coolant input and output conduit jackets in sealing engagement with said assembly, including:

a. input/output connector means;
b. a flow transition region;
c. a conduit for directing coolant flow in an axial direction, wherein said coolant flow covers circumferentially approximately180°; and
d. radial flow directing means disposed in said transition region or said semi-circular conduit, or both, to maintain uniform radial flow patterns.

12. The mold of claim 10, wherein said cylindrical member is configured with an outside surface in the shape of a truncated cone.

13. The mold of claim 10, wherein the conduit defined by adjacent liquid coolant diverters flow translation means whereby coolant flowing is smoothly and uniformly translated from circumferential flow to radial flow such that uniform coolant flow is obtained over the entire surface of each of the curved mold heat exchange surfaces.

14. The mold of claim 1, wherein said mold heat exchange surface includes bubble generator means disposed on said heat exchange surface, for forming nucleate bubbles of predetermined size and distribution to thereby increase heat flux.

15. The mold of claim 14, wherein said mold heat exchange surface has intimately adherent thereto a thin porous metal layer.

16. The mold of claim 15, wherein said porous metal is of relatively uniform pore size.

17. The mold of claim 14, wherein said generating means comprises cavities of predetermined geometry and distribution created in said mold heat exchange surface, said cavities being spaced apart such that at maximum power dissipation the nucleate bubbles formed at said cavities do not coalesce to form an insulating vapor blanket.

18. The mold of claim 14, wherein said cavities on the mold heat exchange surface are of predetermined geometry to provide an optimum formation of nucleate bubbles.

19. The mold of claim 1, wherein said liquid tends to include a viscous sublayer adjacent to said heat exchange surface, said tube further comprising means disposed on said heat exchange surface for breaking up said viscous sublayer to promote removal of said nucleate bubbles.

20. The mold of claim 19, wherein said means for breaking up said viscous sublayer comprises roughness elements formed on said heat exchange surface projecting into said liquid.

21. The mold of claim 20, wherein the liquid cooled mold heat exchange region is further prepared with a calculated surface roughness whose height is no less than 0.3 that of the coolant liquid viscous sublayer and no greater than twice the combined thickness of the coolant liquid viscous sublayer and the transition zone.

22. The mold of claim 20, wherein said surface roughness elements are approximately in the shape of truncated cones whose bases are affixed to the mold, said cones containing approximately centered cavities which are exposed to the liquid, said cone height being no less than 0.3 the height of the viscous sublayer nor more than twice the combined height of the viscous sublayer and transition zone whereby more efficient heat transfer is obtained.

23. The mold of claim 22, wherein said cavities have dimensions in the range of from about 0.002 mm to about 0.2 mm, and said cones are spaced apart such that, at maximum heat flux, nucleate bubbles formed do not coalesce to form the condition of film boiling, said spacing ranging from about 0.3 mm to about 3 mm whereby more efficient heat transfer is obtained.

24. The mold of claim 22, wherein said cavity walls are formed with micro cavities whereby more efficient nucleate boiling is obtained.

25. The mold of claim 24, wherein the dimensions of said micro cavities are in the range of from about $1\times10^{-4}$ mm to about $1\times10^{-2}$ mm whereby more efficient nucleate boiling is obtained.

26. The mold of claim 21, wherein said radial flow directing means are comprised of fins or curved vanes.

* * * * *